US006767437B2

(12) United States Patent
Matsuda et al.

(10) Patent No.: US 6,767,437 B2
(45) Date of Patent: Jul. 27, 2004

(54) ELECTROPLATING APPARATUS AND ELECTROPLATING METHOD

(75) Inventors: Tetsuo Matsuda, Yokohama (JP); Hisashi Kaneko, Fujisawa (JP); Koji Mishima, Fujisawa (JP); Natsuki Makino, Fujisawa (JP); Junji Kunisawa, Yamato (JP)

(73) Assignees: Kabushiki Kaisha Toshiba, Kawasaki (JP); Ebara Corporation, Tokyo (JP)

( * ) Notice: Subject to any disclaimer, the term of this patent is extended or adjusted under 35 U.S.C. 154(b) by 316 days.

(21) Appl. No.: 09/860,514

(22) Filed: May 21, 2001

(65) Prior Publication Data

US 2002/0000379 A1 Jan. 3, 2002

(30) Foreign Application Priority Data

May 22, 2000 (JP) ..... 2000-150253

(51) Int. Cl.[7] ..... C25D 17/00

(52) U.S. Cl. ..... 204/224 R; 204/222; 204/DIG. 7; 205/96; 205/291; 205/102

(58) Field of Search ..... 204/224 R, 222, 204/DIG. 7; 205/96, 291, 102

(56) References Cited

U.S. PATENT DOCUMENTS 6,071,388 A * 6/2000 Uzoh ..... 204/287
6,355,147 B1 * 3/2002 Griffiths et al. ..... 204/242
6,365,017 B1 * 4/2002 Hongo et al. ..... 204/212

FOREIGN PATENT DOCUMENTS

JP 2000-87300 3/2000

* cited by examiner

*Primary Examiner*—Wesley A. Nicolas
(74) *Attorney, Agent, or Firm*—Finnegan, Henderson, Farabow, Garrett & Dunner, L.L.P.

(57) ABSTRACT

In an electroplating apparatus, an electrolytic agent is filled into the portion between an anode and a dummy cathode which is opposite substantially face to face and parallel to the anode, and an electric current is supplied to this portion, thereby suppressing changes in properties of a black film during the period in which plating to a substrate to be processed is stopped. In particular, by applying an electric current to the anode immediately before plating to the substrate is resumed, the film formation characteristics of plating to the substrate can be maximally stabilized. This can reduce the consumption power and dissolution of the anode. This apparatus is particularly effective in copper plating in which the formation of a black film is significant.

14 Claims, 7 Drawing Sheets

| Plating Liquid Circulating Standstill Time (Hour) | Required Maintenace |
|---|---|
| 0~3 | None |
| 3~6 | Anode Burn-in 30 min. |
| 6~12 | Anode Burn-in 90 min. |
| More Than 12 | Anode Cleaning + Anode Burn-in 90 min. |

| Plating Current Off Time (Hour) | Required Maintenace |
|---|---|
| 0~12 | None |
| 12~14 | Anode Burn-in 30 min. |
| 24~72 | Anode Burn-in 90 min. |
| More Than 72 | Anode Cleaning + Anode Burn-in 90 min. |

| Sample No. | Plating Interval (min.) | Current Density At Anode | Film Thickness Variation (1σ%) | Filling Performance | Abnormal Precipitaion On Plated Surface |
|---|---|---|---|---|---|
| 1 | 0 | FIG. 7A | 2.5 | Good | None |
| 2 | 30 | FIG. 7A | 8.5 | Fair | None |
| 3 | 120 | FIG. 7A | 9.2 | Fair | A Little |
| 4 | 360 | FIG. 7A | 11.7 | Poor | Much |
| 5 | 360 | FIG. 7B | 2.4 | Good | None |
| 6 | 360 | FIG. 7C | 3.3 | Good | None |
| 7 | 360 | FIG. 7D | 2.7 | Good | None |
| 8 | 360 | FIG. 7E | 2.5 | Good | None |
| 9 | 360 | FIG. 7F | 3.0 | Fair | A Little |
| 10 | 360 | FIG. 7G | 3.6 | Good | None |
| 11 | 3600 | FIG. 7B | 2.5 | Good | None |
| 12 | 3600 | FIG. 7E | 2.3 | Good | None |

FIG. 6

ELECTROPLATING APPARATUS AND ELECTROPLATING METHOD

CROSS-REFERENCE TO RELATED APPLICATIONS

This application is based upon and claims the benefit of priority from the prior Japanese Patent Application No. 2000-150253, filed May 22, 2000, the entire contents of which are incorporated herein by reference.

BACKGROUND OF THE INVENTION

The present invention relates to copper plating and, more particularly, to an electroplating apparatus and electroplating method of performing single wafer processing for semiconductor substrates and the like.

Electroplating of copper which has been often used in plating industries for a long time is recently attracting attention as a multilayered wiring process for semiconductors. This is so because copper having low resistivity is beginning to be used as a multilayered wiring material of semiconductors. In addition, film formation by plating is superior in step coverage and hence well matches a wiring formation process (damascene process). Also, film formation by plating is possible at higher speed and lower cost than film formation by, e.g., sputtering. These are other reasons of the introduction of the plating process.

In copper plating, however, caution should be exercised on a thin black film called a "black film" formed on the surface of an anode. This black film is presumably a compound of oxygen or chlorine contained in a plating liquid and copper or phosphorus contained in phosphorus containing copper as an anode material. When a substrate to be processed is plated, copper is formed on the substrate as a cathode and a black film is formed on an anode by application of electricity.

This black film is stable as long as electricity is supplied to a plating liquid. However, when electricity is turned off or the anode is pulled up from the plating liquid, the black film is lost as it is removed from the anode or dissolved in the plating liquid. If the black film is partly lost on the surface of the anode, the uniformity of film formation on the wafer as a substrate to be processed significantly lowers, or a precipitation is formed on the film surface.

In practice, therefore, if the time during which an electroplating apparatus is unused exceeds a predetermined time, electricity is applied by using a dummy wafer to intentionally form a black film. This is called "anode burn-in". This anode burn-in is indispensable to stably obtain performance (e.g., filling performance and film thickness uniformity) of copper plating.

Furthermore, even on an anode such as an indissoluble anode on which no black film is formed, oxidation of the anode occurs owing to application of an electric current. This makes the state of the anode surface when electricity is applied different from that when the anode is left to stand for a long time period. Therefore, anode burn-in is necessary regardless of the presence/absence of a black film.

Accordingly, after plating to a wafer to be processed is stopped for a predetermined time, anode burn-in to a dummy wafer must be performed prior to wafer plating in the next process. This significantly lowers the utilization efficiency of the electroplating apparatus.

An example of anode burn-in and its problem will be described below by taking a cup type electroplating apparatus most extensively used in the semiconductor industries as an example. FIG. 1 is a sectional view of the cup type electroplating apparatus whose main purpose is copper plating. As shown in FIG. 1, this apparatus comprises a plating liquid 2 filled and circulated in a cup 1, an anode 3 placed in the cup 1, an electrode 5 for giving a negative potential to the surface of a wafer 4 facing the anode 3, a seal 6 for preventing the plating liquid 2 from contacting the electrode 5, and a power supply 7 for supplying an electric current to the wafer 4 and the anode 3.

The plating liquid is usually an aqueous solution mixture of copper sulfate, sulfuric acid, and hydrochloric acid. When the wafer 4 is completely processed and retracted, no electric current flows to the anode 3 any longer. The anode 3 is exposed to the plating liquid 2 in this state. Alternatively, the anode 3 is exposed to the atmosphere if the plating liquid 2 is discharged from the cup 1. In either case, a black film formed on the surface of the anode 3 changes in properties with time. Hence, the manufacturer of the apparatus recommends maintenance, e.g., as shown in FIGS. 2 and 3.

As shown in FIGS. 2 and 3, when the electroplating apparatus is set in a standby state after plating is completed, a preparation time before plating becomes possible and is needed in order to resume plating. That is, the actual wafer processing of the electroplating apparatus is very wasteful in Large Scale Integration (LSI) factories, and this raises the LSI process cost. In particular, the multilayered wiring step is in the latter half of the LSI fabrication process. In a factory, therefore, predetermined numbers of wafers are anode but large numbers of wafers are intermittently supplied. Accordingly, anode burn-in explained above sometimes occupies nearly ⅓ of the operation time of the electroplating apparatus. This is a serious problem in the LSI fabrication process.

BRIEF SUMMARY OF THE INVENTION

It is an object of the present invention to provide an electroplating apparatus and electroplating method capable of improving the throughput by reducing the anode burn-in time.

To achieve the above object, an electroplating apparatus according to the first aspect of the present invention comprises a holder configured to hold a substrate to be processed serving as a cathode, a dummy cathode placed in a position different from the holder, an anode capable of facing, substantially face to face, both a surface to be plated of the substrate held by the holder and the dummy cathode, a moving mechanism configured to move the anode between the substrate holder and the dummy electrode, and a power supply connected between the dummy cathode and the anode to supply an electric current between the anode and the dummy cathode via an electrolytic agent filled between the dummy cathode and the anode.

An electroplating apparatus according to the second aspect of the present invention comprises a cup to be filled with an electrolytic agent, an anode placed on a bottom of the cup, a holder for holding a substrate to be processed in an upper portion of the cup, such that a surface to be plated of the substrate faces the anode, a dummy cathode capable of moving, as needed, to a position between the anode and the substrate, a moving mechanism for retracting the dummy cathode when the substrate is to be plated, and opposing the dummy cathode substantially face to face to the anode when plating of the substrate is stopped, and a power supply connected between the dummy cathode and the anode.

An electroplating method according to the third aspect of the present invention comprises the steps of preparing a dummy cathode, opposing a plate-like anode substantially face to face and parallel to the dummy cathode via an electrolytic agent, with no electricity applied, supplying an electric current between the anode and the dummy cathode after the step of opposing the anode to the dummy cathode, and opposing a substrate to be processed serving as a cathode to the anode via an electrolytic agent and forming a plating film on the substrate, after the step of supplying an electric current between the anode and the dummy cathode.

In the present invention, changes in properties of a black film are suppressed by filling an electrolytic agent into a portion between an anode and a dummy cathode which is opposite substantially face to face and parallel to the anode, and supplying an electric current to this portion. Since extra anode burn-in is unnecessary, the throughput improves.

The effect of the present invention is large in copper plating in which the formation of a black film is significant. The consumption power and dissolution of the anode can be reduced by applying an electric current to the anode immediately before resumption of plating or by intermittently applying this electric current. In particular, the film formation characteristics of plating to a substrate to be processed can be maximally stabilized by applying the electric current to the anode immediately before the substrate is plated.

When both the dummy cathode and the anode are substantially flat plates and the apparatus comprises a mechanism capable of maintaining these cathode and anode parallel to each other, the density of an electric current flowing through the anode becomes uniform, so a uniform black film can be formed on the anode. This can realize a uniform plating film growth rate and uniform film formation characteristics over the entire surface of a substrate to be processed. When phosphorus containing copper is used as the anode, the formation of a black film occurs stably, and this makes the effect of the present invention remarkable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 6 is a diagram showing the performance of a plating film with respect to various intervals and various dummy cathode power supply conditions in the first embodiment;

DETAILED DESCRIPTION OF THE INVENTION

Embodiments of the present invention will be described with reference to the accompanying drawings.

[First Embodiment]

The point of the first embodiment is that an anode is retracted from a plating position or from the position of a plating liquid and electrolysis is performed using a dummy cathode placed in the retracted position.

In this first embodiment, an impregnation type electroplating apparatus will be explained. Impregnation is the state in which a plating liquid is held by an impregnating body composed of a solid except for a liquid, a solid-liquid mixture, a gas mixture and the like. In this state, the spatial movement of the plating liquid is limited to some extent compared to a case in which the liquid is singly present in a vessel. When the impregnating body comes in contact with a substrate to be processed, the plating liquid acts on the substrate.

Note that a portion of the impregnating body may not be in contact with a substrate to be processed in some cases. Even in this case, however, the plating liquid can be supplied to the substrate (by, e.g., surface tension) near the contact portion between the impregnating body and the substrate. This state can be permitted in accordance with the purpose of a technique to be carried out or can also be avoided if the state is inconvenient for the purpose of a technique to be carried out.

Figure 4:
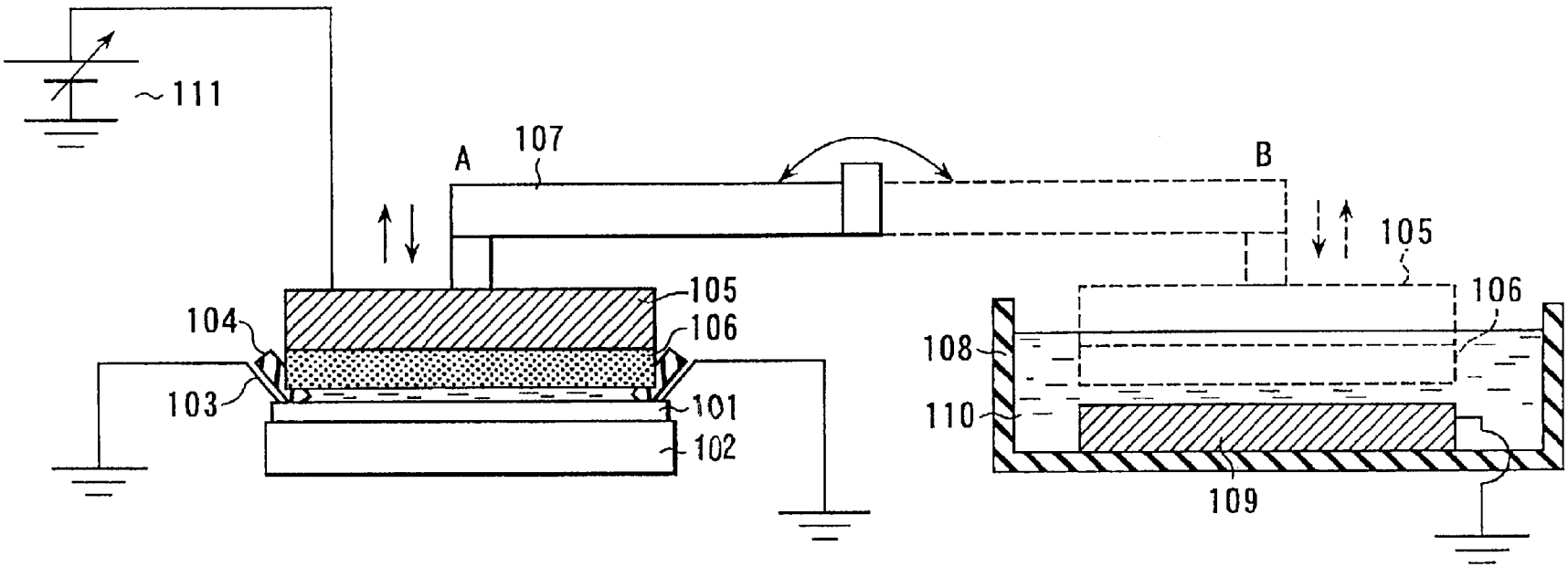
FIG. 4 is a view showing an outline of the arrangement of an impregnation type electroplating apparatus according to the first embodiment of the present invention.

FIG. 4 is a sectional view showing an outline of the arrangement of a plating apparatus according to the first embodiment of the present invention. As shown in FIG. 4, a wafer (substrate to be processed) 101 is placed facing up on a support base 102. This wafer 101 is fabricated by sequentially stacking a 30-nm thick Ta film and a 100-nm thick Cu film in this order by sputtering. A cathode contact 103 for applying a cathode potential is connected to the surface of the wafer 101. A seal 104 for protecting this cathode contact 103 from a plating liquid is formed inside on the wafer 101 with respect to the cathode contact 103.

An impregnating sponge 106 made of PVA (PolyVinyl Alcohol) containing a plating liquid (electrolytic agent) and a flat anode 105 made of phosphorus containing copper face the surface of the wafer 101. The anode 105 is connected to a power supply 111.

This anode 105 and the impregnating sponge 106 can be moved by the motion of an arm (moving mechanism) 107. Therefore, the anode 105 and the impregnating sponge 106 can be retracted to a retracted position B different from a plating position A.

In the retracted position B, a vessel 108 filled with a plating liquid 110 is placed. This vessel 108 contains a metal dummy cathode 109. Before the wafer 101 is plated in the plating position A, an electric current is supplied between the anode 105 and the dummy cathode 109 in the retracted position B.

This step can also be performed when the apparatus is standing by to wait for a substrate to be processed. It is also possible to perform the step before or after a substrate is plated, e.g., during transfer or drying of a substrate. Therefore, this step does not lower the throughput (substrate processing capability) of the apparatus.

The standard conditions of copper plating used in the first embodiment are as follows. The components of the plating liquid 110 are copper sulfate pentahydrate ($CuSO_4 \cdot 5H_2O$): 250 g/liter, sulfuric acid ($H_2SO_4$): 180 g/liter, and hydrochloric acid (HCl): 60 mg/liter. In addition, additives such as a polymer and a complex compound are added for diverse purposes, e.g., to control the pH and stability of the plating liquid, to protect the anode, to smooth the surface of a formed film, and to control the crystal grain of a formed film.

Note that the arm 107 preferably has a mechanism which maintains the substrate 101 parallel to the anode 105 and the anode 105 parallel to the dummy cathode 109. Both the dummy cathode and the anode are flat plates. Hence, if the arm 107 has a mechanism capable of holding these cathode and anode in parallel to each other, the density of electric current flowing through the anode becomes uniform, so a uniform black film can be formed on the anode. This can realize a uniform plating film growth rate and uniform film formation characteristics over the entire surface of a substrate to be processed.

Figure 5:
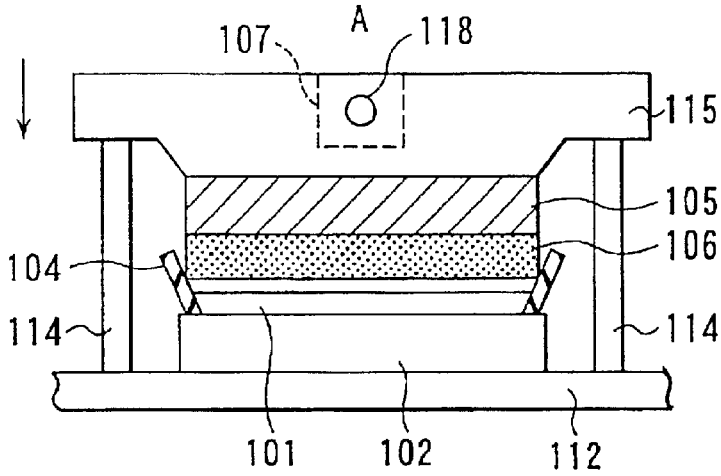
FIG. 5 is a schematic sectional view for explaining a mechanism for holding an anode and a cathode (or a substrate holder) parallel to each other in the first embodiment.
Figure 7A:
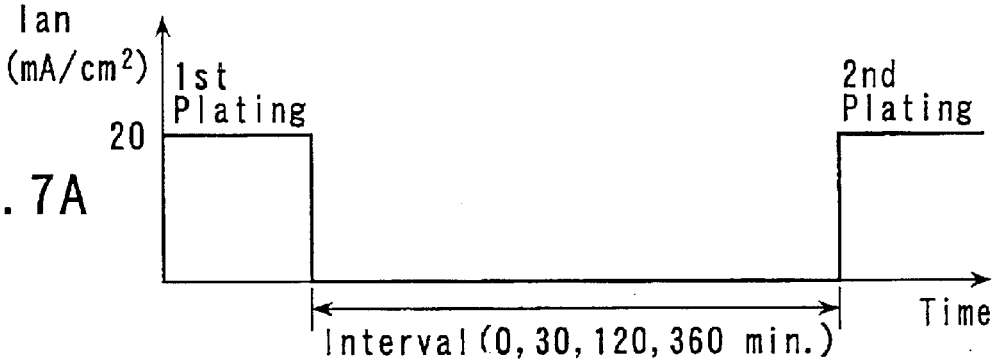
FIGS. 7A to 7G are timing charts of the diverse dummy cathode power supply conditions shown in FIG. 6.
Figure 7B:
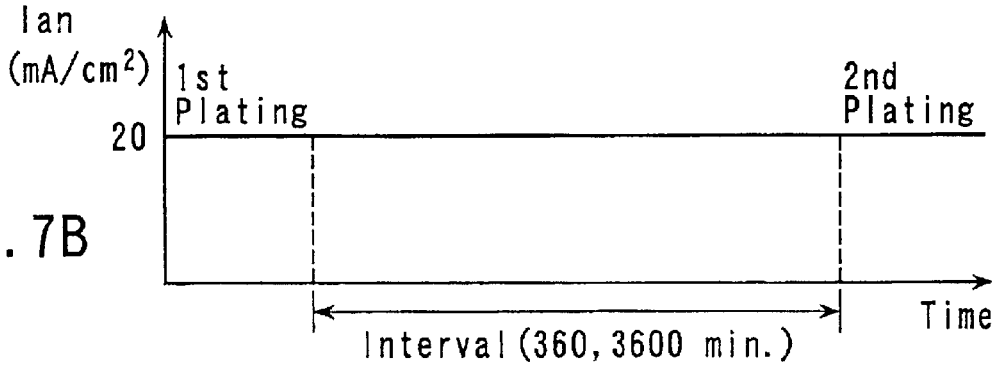
Figure 7C:
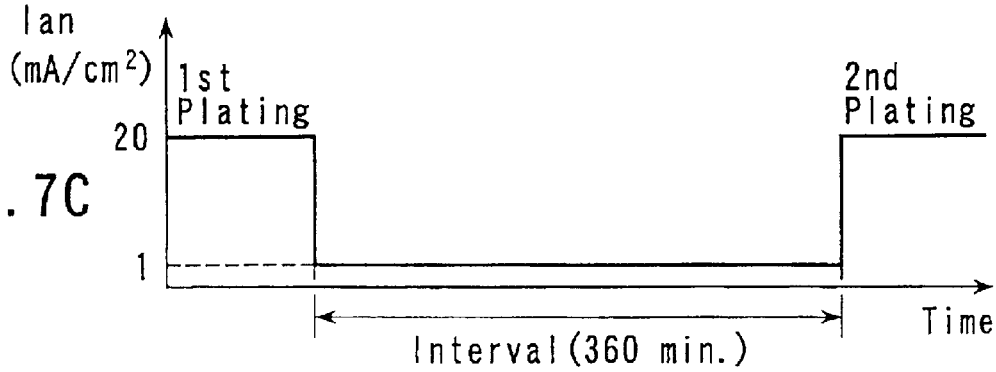
Figure 7D:
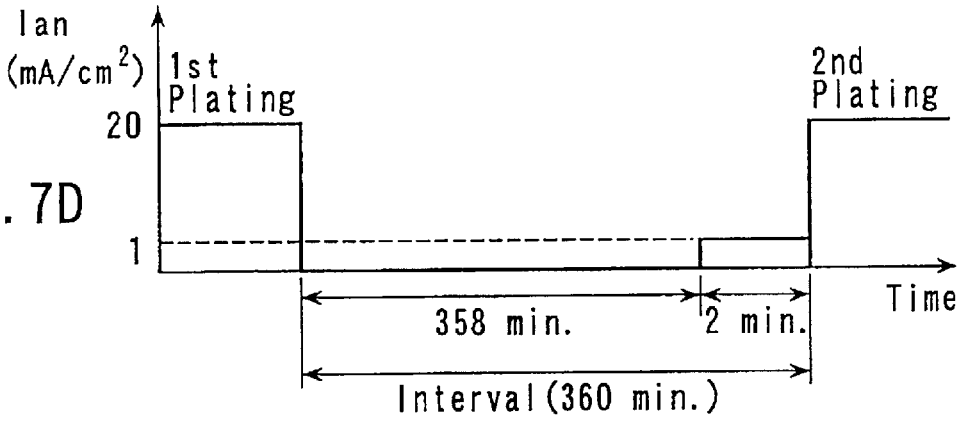
Figure 7E:
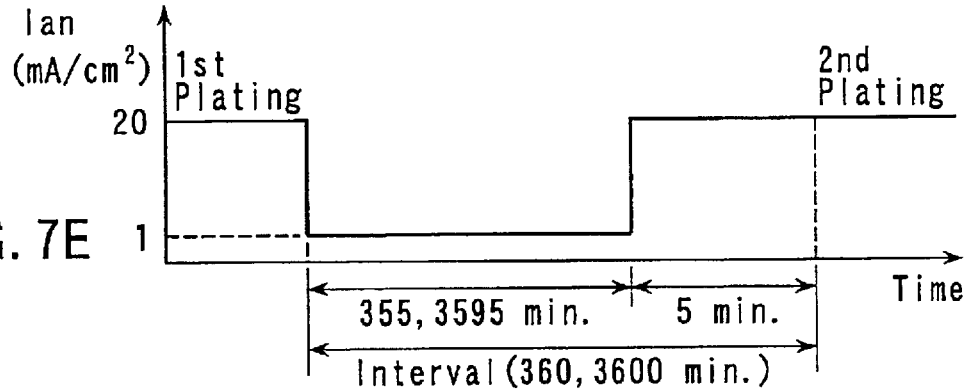
Figure 7F:
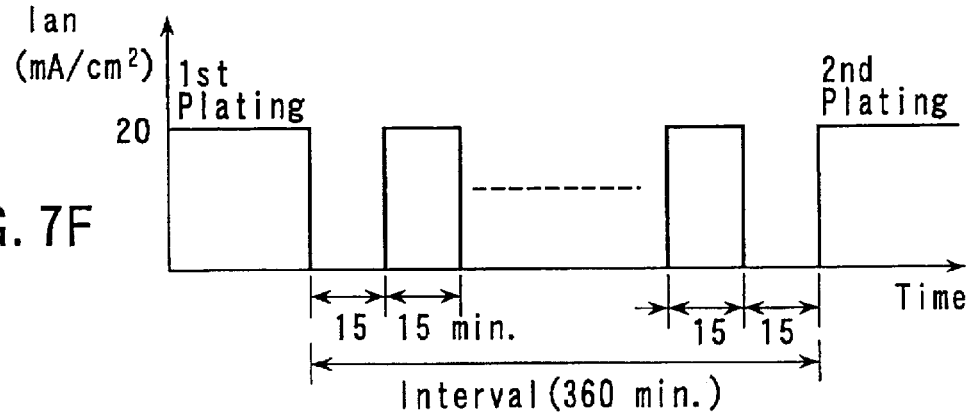
Figure 7G:
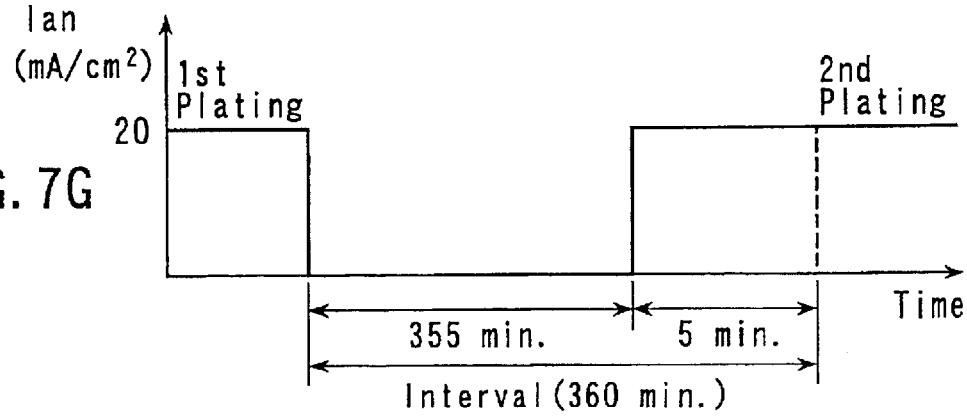

An example of the mechanism for holding the substrate 101 in parallel to the anode 105 is shown in FIG. 5. FIG. 5 shows a section perpendicular to the paper surface at the point A in FIG. 4. A pair of positioning pins 114 are formed on a support plate 112 on which the support base 102 is mounted. A holder 116 for holding the anode 105 is connected to the arm 107 via a universal joint 118. When the holder 116 moves down from the above and settles in the plane defined by the positioning pins 114, the opposing surfaces of the anode 105 and the substrate 101 can be made parallel to each other. The anode 105 and the dummy cathode 109 can also be made parallel in a similar way.

Examples of the impregnating sponge 106 other than PVA are porous ceramic, porous Teflon, polypropyrene knitted into the form of fibers or processed into the form of paper, and materials having indeterminate forms such as silica gel and agar.

The size of pores or voids is not unconditionally defined but changes in accordance with, e.g., the viscosity of a liquid or the wettability/surface tension generated between an impregnating body and a liquid. Basically, an impregnating body can be any material as long as the material can hold a liquid and can achieve a state in which the spatial movement of the liquid is limited (e.g., the most part of the liquid does not flow out with no receiver).

The first embodiment uses an impregnation plating method by taking account of the ease with which the plating liquid is held. However, an impregnating sponge is not always necessary. Also, as described previously, the plating liquid can be held by forming a narrow gap between the surface of a substrate to be processed and the surface of an impregnating sponge by using surface tension. In FIG. 4, the seal 104 is also served as a spacer to provide the narrow gap.

The impregnating sponge is brought into tight contact with a conductor layer of the wafer to supply the plating liquid from this impregnating sponge to the surface of the conductor layer. An electric current having a current density of 20 mA/cm$^2$ is supplied from the power supply to the anode 105. When the electric current was thus supplied to the anode 105, a thin copper plating film is formed on the surface of the conductor layer electrically connected to the anode contact 103.

After this thin copper plating film is formed on the wafer, the impregnating sponge 106 and the anode 105 are moved to the retracted position B and dipped into the plating liquid 110 in the cup 108 by the arm 107, and an electric current is supplied between the anode 105 and the dummy cathode 109. The dummy cathode 109 and the wafer 101 have substantially the same size in this case.

In this embodiment, the anode 105 is moved to the retracted position B by means of the arm 107. However, the moving means is not restricted to the arm, but the anode 105 may be moved manually.

While the conditions of the electric current supplied between the anode 105 and the dummy cathode 109 at the retracted position B were variously changed, the variation of the thickness of a copper electroplating film formed on an 8-inch wafer and the filling performance of the film with respect to grooves and pores were evaluated. FIG. 6 shows the evaluation results of the copper electroplating films formed. Also, the conditions (current densities) of power supply to the anode shown in FIG. 6 are illustrated in FIGS. 7A to 7G.

Sample Nos. 1 to 4 were formed by changing only the interval between wafer plating processes, with no electricity supplied to the dummy cathode. In each of FIGS. 7A to 7G, the anode current density ($I_{an}$) during wafer (cathode) plating and the anode current density ($I_{an}$) during anode burn-in using the dummy cathode are plotted on the same timing chart for the sake of convenience. "First plating" is for one arbitrary wafer in single wafer plating, and "second plating" is for the next wafer. "Interval" is the time between the first and second plating processes. As shown in FIG. 6, the film thickness variation and filling performance deteriorated even with a process interval of only 30 min. FIG. 6 also shows that the longer the interval, the larger the amount of abnormal precipitation on the plated surface.

Sample No. 5 was formed with an interval of 360 min by continuously supplying electricity to the dummy cathode under the same conditions as the wafer plating conditions. The film thickness variation and filling performance naturally came into the category of best performance. However, deterioration of the dummy plating liquid accelerated, and the consumption power was also large.

Sample No. 6 was formed with an interval of 360 min by continuously supplying electricity by 1 mA/cm$^2$ to the dummy cathode. Although the film thickness variation was inferior to sample No. 5, considerably good results were obtained.

Sample No. 7 was formed with an interval of 360 min by initially supplying no electricity to the dummy cathode and then continuously supplying electricity by 1 mA/cm$^2$ to the dummy cathode two minutes before wafer plating was resumed. Although the film thickness variation and filling performance were good, an abnormal precipitation was slightly formed on the plated surface.

Sample No. 8 was formed with an interval of 360 min by continuously supplying electricity to the dummy cathode initially by 1 mA/cm$^2$ and then by 20 mA/cm$^2$ (the same condition as wafer plating) five minutes before wafer plating was resumed. The results belonged to the category of best performance.

Sample No. 9 was formed with an interval of 360 min by repeating supply of no electricity for 15 min and supply of 20 mA/cm$^2$ to the dummy cathode for 15 min. Although the filling performance and the formation of abnormal precipitation were slightly inferior, the film thickness variation was reduced.

Sample No. 10 was formed with an interval of 360 min by initially supplying no electricity and then continuously supplying electricity to the dummy cathode by 20 mA/cm$^2$ five minutes before wafer plating was resumed. Although the film thickness variation was slightly large, generally good results were obtained.

Sample No. 11 was formed with an interval of 3,600 min by continuously supplying electricity to the dummy cathode under the same conditions as the wafer plating conditions. The film thickness variation and filling performance naturally came into the category of best performance. However, deterioration of the dummy plating liquid accelerated, and the consumption power was also large.

Sample No. 12 was formed with an interval of 3,600 min by continuously supplying electricity to the dummy cathode initially by 1 mA/cm$^2$ and then by 20 mA/cm$^2$ (the same condition as wafer plating) five minutes before wafer plating was resumed. The results also belonged to the category of best performance.

Note that electricity was supplied five or two minutes before plating was resumed because, when wafer plating is resumed by single wafer processing, a wafer often requires one to ten minutes to reach the plating stage after being loaded onto the plating apparatus, so five or two minutes was set as a representative value. The efficiency of the plating process can be increased by supplying electricity to the dummy cathode by using this dead time of one to ten minutes.

As described above, given film thickness variation and filling performance can be maintained by continuously or intermittently supplying electricity to the dummy cathode placed in the anode retracted position B. Also, the consumption power and anode dissolution can be suppressed by decreasing the electric current supplied to the anode or intermittently supplying this electric current.

Intermittent current supply is not limited to the conditions shown in FIGS. 7D, 7E, 7F, and 7G. For example, effects were confirmed even with pulses of milliseconds. As in sample No. 6, effects were confirmed even when a very low electric current of 1 mA/cm$^2$ was supplied. This means that no large electric current need be supplied to prevent removal of a previously formed black film. In this case, the potential difference between the dummy cathode and the anode was approximately 0.3V, a very low value.

The current density need not be equal to that during wafer plating, and effects can be obtained even by a low current density. However, larger effects can be obtained when electricity is supplied with a high current density immediately before the wafer process. Pulses are effective as well as a direct current, and the current value can exceed the current density during wafer plating.

[Second Embodiment]

The present invention can also be applied to the cup type electroplating apparatus described in BACKGROUND OF THE INVENTION. That is, a dummy cathode is placed inside a cup for wafer plating without using any dummy wafer, and a black film is stabilized by supplying electricity between this dummy cathode and an anode.

Figures 1, 2, 3:
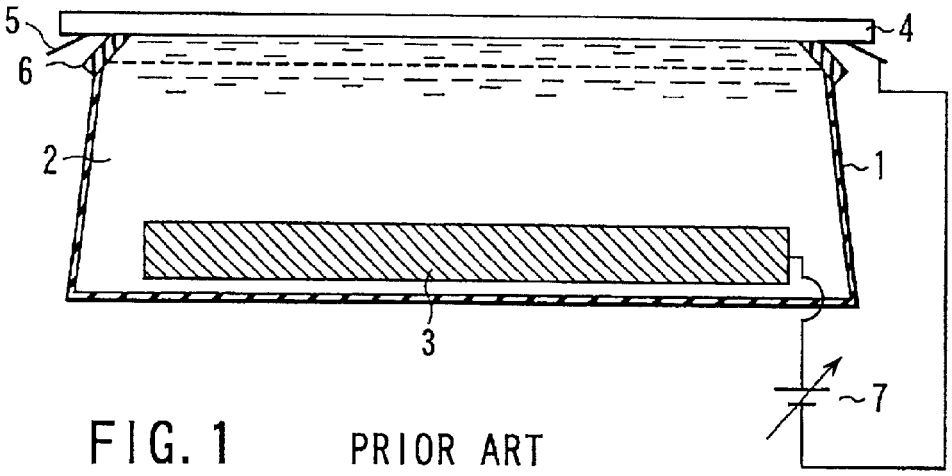
FIG. 1 PRIOR ART
FIG. 2 PRIOR ART
FIG. 3 PRIOR ART
FIG. 1 is a sectional view showing an outline of the arrangement of a conventional cup type electroplating apparatus.
FIG. 2 is a diagram showing the relationship between the plating liquid circulating standstill time and the maintenance item necessary before resumption of circulation.
FIG. 3 is a diagram showing the relationship between the plating current off time and the maintenance item necessary before resumption of power supply.
Figure 8A:
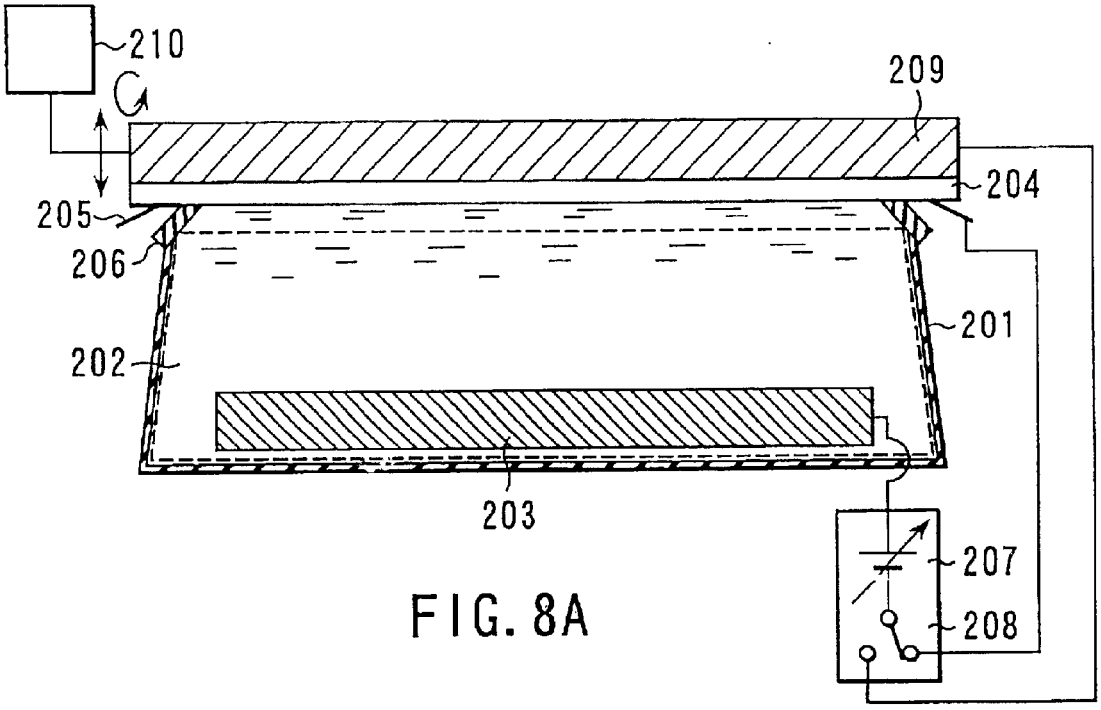
FIGS. 8A and 8B are schematic sectional views showing an outline of the arrangement of a cup type electroplating apparatus and showing a method of anode burn-in by stages according to the second embodiment of the present invention.
Figure 8B:
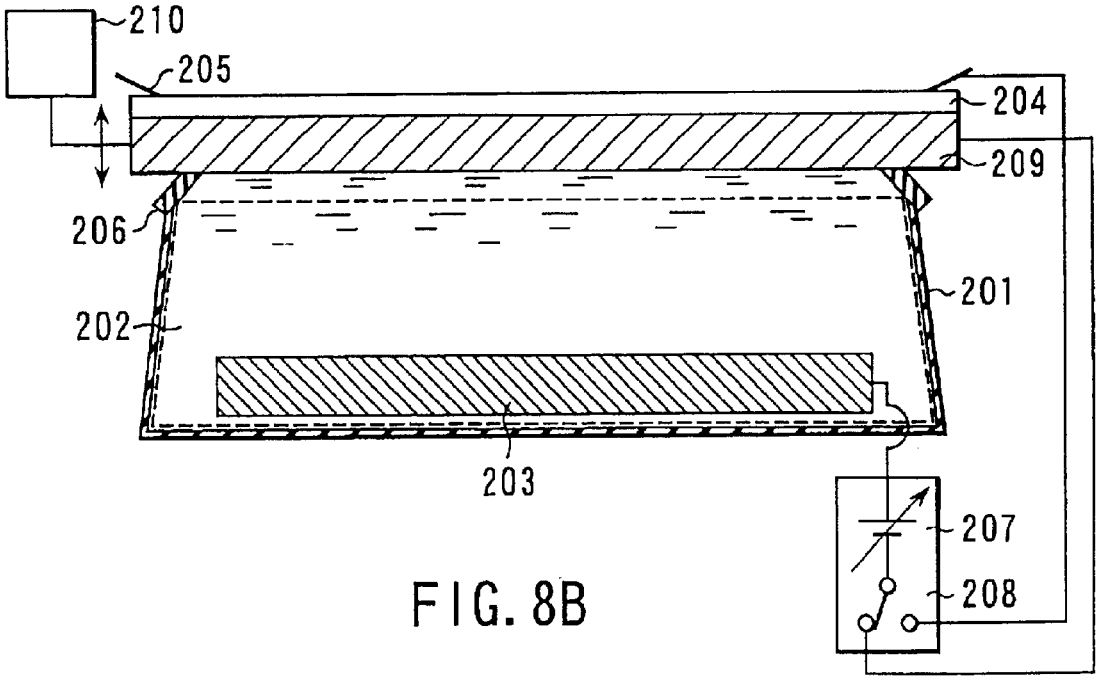

FIGS. 8A and 8B are sectional views showing the arrangement of a cup type electroplating apparatus according to the second embodiment of the present invention. FIG. 8A shows the state in which a wafer 204 is to be electroplated. This arrangement is basically the same as the conventional cup type electroplating apparatus shown in FIG. 1. That is, an anode 203 is placed in a cup 201. A plating liquid 202 is filled and circulated in this cup 201. An electrode 205 gives a negative potential to the surface of the wafer 204 facing the anode 203. A seal 206 prevents the plating liquid from contacting the electrode 205. A variable power supply 207 applies a desired electric current to the wafer 204 and the anode 203. The wafer 204 is held by a metal holder 209.

During wafer transfer before and after a wafer plating process, the wafer 204 is raised and inverted 180° together with the holder 209 by a holder control mechanism 210. In this state, a plated wafer 204 is unloaded, and a new wafer 204 to be plated is loaded.

In the second embodiment, the wafer holder 209 also serves as a dummy cathode. With the wafer 204 unloaded (or loaded), the wafer holder 209 moves down to the upper surface of the cup 201 and comes in liquid contact with the plating liquid 202 (FIG. 8B). In a standby state before next wafer plating is started, an electric current is supplied between the dummy cathode 209 and the anode 203 via the plating liquid 202. That is, the variable power supply 207 is so adjusted as to supply a desired dummy plating current (burn-in current), and connected to the dummy cathode 209 by a switch 208. "Liquid contact" is a method in which the plating liquid surface is gradually raised over a long time to come into contact with the wafer surface (or the dummy cathode). The method is often used to prevent the generation of bubbles between the wafer and the plating liquid surface.

Figure 9A:
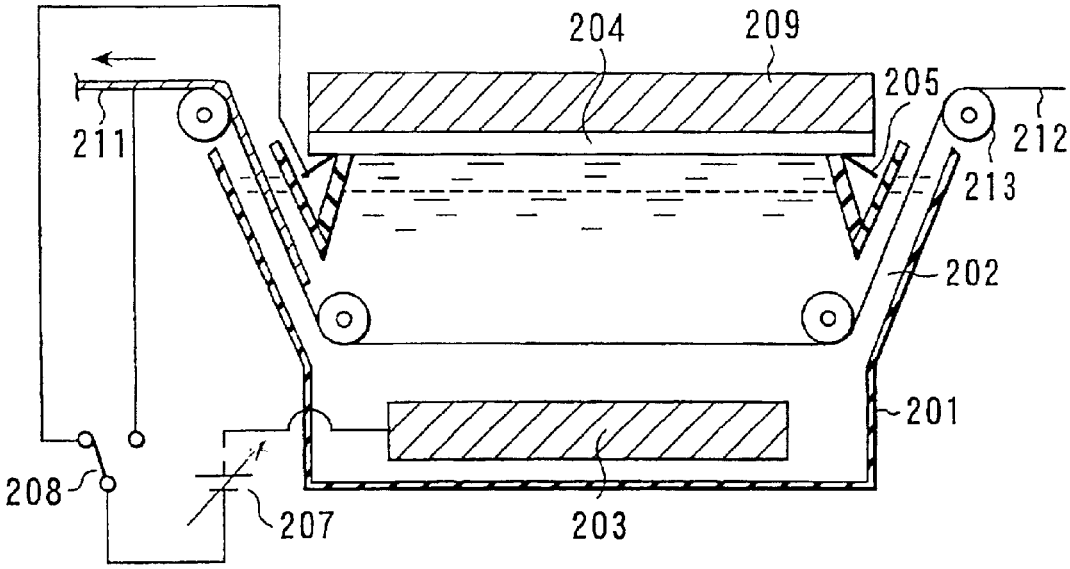
FIGS. 9A and 9B are schematic sectional views showing an outline of the arrangement of a cup type electroplating apparatus and showing a method of anode burn-in by stages according to a modification of the second embodiment.
Figure 9B:
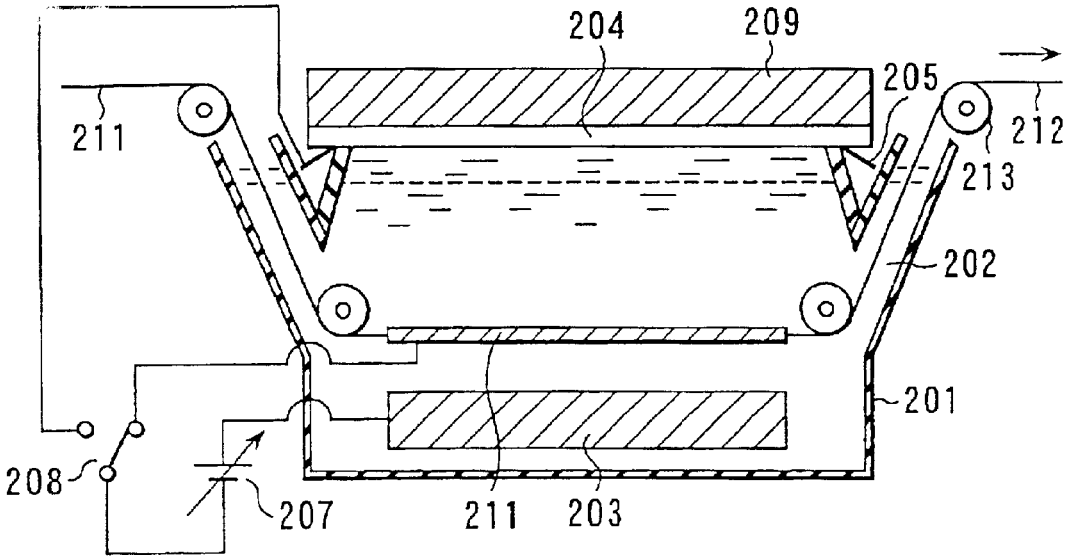

In this second embodiment, the wafer holder 209 is used as a dummy cathode. However, a dedicated dummy cathode can also be used and retracted by a moving mechanism when a plating film is formed on the substrate 204 to be processed. FIGS. 9A and 9B illustrate this modification.

A dummy cathode 211 is a flexible belt of a mesh metal or woven metal wires. During wafer plating shown in FIG. 9A, this dummy cathode 211 is pulled by a moving wire (moving mechanism) 212 and retracted to the outside of a cup 201 while being guided by a roller 213.

During burn-in of an anode 203, as shown in FIG. 9B, the dummy electrode 211 is introduced into the cup 201 so that the surfaces of this dummy electrode 211 and the anode 203 are parallel to each other. A desired electric current is supplied between the dummy electrode 211 and the anode 203 from a variable power supply 207 via a switch 208.

FIG. 9B shows the liquid contact state of the wafer 204. However, this wafer 204 can also be separated from the plating liquid 210 and unloaded.

The present invention is not restricted to the above embodiments. For example, the portion between an anode and a dummy cathode is filled with a plating liquid used in wafer plating. However, it is unnecessary to use the same plating liquid as for forming a plating film. That is, another plating liquid or an electrolytic agent having a different additive or metal concentration can also be used.

The process conditions are standard conditions for convenience for explaining the embodiments of the present invention. Therefore, the individual parameters as well as the plating metal can be appropriately changed without departing from the gist of the present invention.

In the present invention as has been explained above, in a plating standby period, an electrolytic agent is filled into the portion between an anode and a dummy cathode which is opposite substantially face to face and parallel to the anode, and an electric current is supplied to this portion. Since this suppresses changes in properties of a black film and makes extra anode burn-in process unnecessary, the throughput of the plating process improves.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electroplating apparatus comprising:

a holder configured to hold a substrate to be processed, said substrate serving as a cathode and being connected to a cathode contact;

a dummy cathode placed in a position different from said holder;

an anode capable of facing, substantially face to face, both a surface to be plated of said substrate held by said holder and said dummy cathode; alternately;

a moving mechanism configured to move said anode between a position facing said substrate holder and a position facing said dummy cathode; and a power supply connected between said cathode contact and said anode, and between said dummy cathode and said anode to supply an electric current between said anode and said dummy substrate, and between said anode and said dummy cathode via an electrolytic agent filled between said substrate and said anode, and between said dummy cathode and said anode.

2. The apparatus according to claim 1, wherein a surface of said anode which faces said substrate holder or said dummy cathode includes an impregnating body which contains said electrolytic agent.

3. The apparatus according to claim 2, further comprising a spacer which defines a space between said substrate and said impregnating body when said impregnating body faces said substrate held by said holder.

4. The apparatus according to claim 3, wherein the space is a distance by which a portion between said substrate and said impregnating body is filled with said electrolytic agent by a surface tension of said electrolytic agent.

5. The apparatus according to claim 1, further comprising a cup configured to exclusively accommodate said dummy cathode other than said substrate and holding said electrolytic agent.

6. The apparatus according to claim 1, wherein said dummy cathode and said anode are substantially flat plates, and said electroplating apparatus further comprises a mechanism configured to maintain said dummy cathode and said anode in parallel to each other.

7. The apparatus according to claim 1, wherein said anode is made of phosphorus containing copper.

8. An electroplating apparatus comprising:

a cup to be filled with an electrolytic agent;

an anode placed on a bottom of said cup;

a holder which holds a substrate to be processed and serving as a cathode in an upper portion of said cup, such that a surface to be plated of said substrate faces said anode;

a dummy cathode capable of moving, as needed, to be interposed between said anode and said substrate;

a moving mechanism configured to interpose said dummy cathode between said anode and said substrate to oppose said dummy cathode substantially face to face to said anode when plating of said substrate is stopped, and to retract said dummy cathode away from said anode when said substrate is to be plated; and a power supply connected between said substrate and said anode, and between said dummy cathode and said anode.

9. The apparatus according to claim 8, wherein said substrate holder functions as said dummy cathode.

10. The apparatus according to claim 8, wherein said dummy cathode is a flexible cathode made of a material selected from the group consisting of a mesh metal and woven metal wires, and is retracted to an outside of said cup when said substrate is to be plated, and is introduced into said cup to face said anode when plating of said substrate is stopped.

11. The apparatus according to claim 8, wherein said moving mechanism comprises a mechanism configured to maintain said dummy cathode substantially in parallel to said anode.

12. The apparatus according to claim 8,wherein said anode is made of phosphorus containing copper.

13. An electroplating apparatus comprising:

a cup to be filled with an electrolytic agent;

an anode placed on a bottom of said cup;

a metal plate holder which holds a substrate to be processed and serving as a cathode in an upper portion of said cup, such that a surface to be plated of said substrate faces said anode, said metal plate holder being disposed on said substrate back to back;

a holder control mechanism configured to dispose said metal plate holder, as a dummy cathode, to face said anode when plating of said substrate is stopped; and a power supply connected between said substrate and said anode, and between said dummy cathode and said anode.

14. The apparatus according to claim 13, wherein said anode is made of phosphorus containing copper.

* * * * *

UNITED STATES PATENT AND TRADEMARK OFFICE

CERTIFICATE OF CORRECTION

PATENT NO. : 6,767,437 B2
DATED : July 27, 2004
INVENTOR(S) : Matsuda et al.

It is certified that error appears in the above-identified patent and that said Letters Patent is hereby corrected as shown below:

Column 9,
Line 19, change “cathode; alternatively;” to -- cathode, alternatively; --
Line 26, change “said dummy substrate” to -- said substrate --.

Signed and Sealed this

Thirtieth Day of November, 2004

JON W. DUDAS
*Director of the United States Patent and Trademark Office*